US005871128A

United States Patent [19]

Carroll

[11] Patent Number: 5,871,128

[45] Date of Patent: Feb. 16, 1999

[54] GLUE-DISPENSING BOTTLE WITH IMPROVED NOZZLE ASSEMBLY

[76] Inventor: George H. Carroll, 2392 Foster Ave., Ventura, Calif. 93001

[21] Appl. No.: 677,632

[22] Filed: Jul. 8, 1996

[51] Int. Cl.[6] ..... B65D 37/00

[52] U.S. Cl. ..... 222/568; 222/212

[58] Field of Search ..... 222/206, 212, 222/215, 567, 568; 215/263

[56] References Cited

U.S. PATENT DOCUMENTS

| | | | |
|---|---|---|---|
| 4,498,609 | 2/1985 | Stock | 222/567 X |
| 5,156,303 | 10/1992 | Yamamoto et al. | 222/215 X |
| 5,360,127 | 11/1994 | Barriac et al. | 215/263 |

FOREIGN PATENT DOCUMENTS

| | | | |
|---|---|---|---|
| 2066764 | 7/1981 | United Kingdom | 222/215 |
| 2193193 | 7/1986 | United Kingdom | 222/567 |

*Primary Examiner*—Joseph Kaufman
*Attorney, Agent, or Firm*—Dennis H. Lambert

[57] ABSTRACT

A container for holding and dispensing glue includes a bottle having an open end and a nozzle secured in the open end for closing the open end but enabling glue to be dispensed through the nozzle. An overcap is engageable on the bottle in enclosing relationship to the nozzle to close and seal the nozzle when not in use. Interengaged detents are on the bottle and the nozzle to prevent relative axial and rotational movement therebetween to prevent inadvertent dislodgement of the nozzle from the bottle, and seal rings are engaged between the nozzle and the bottle to prevent leakage of glue between the nozzle and bottle.

20 Claims, 5 Drawing Sheets

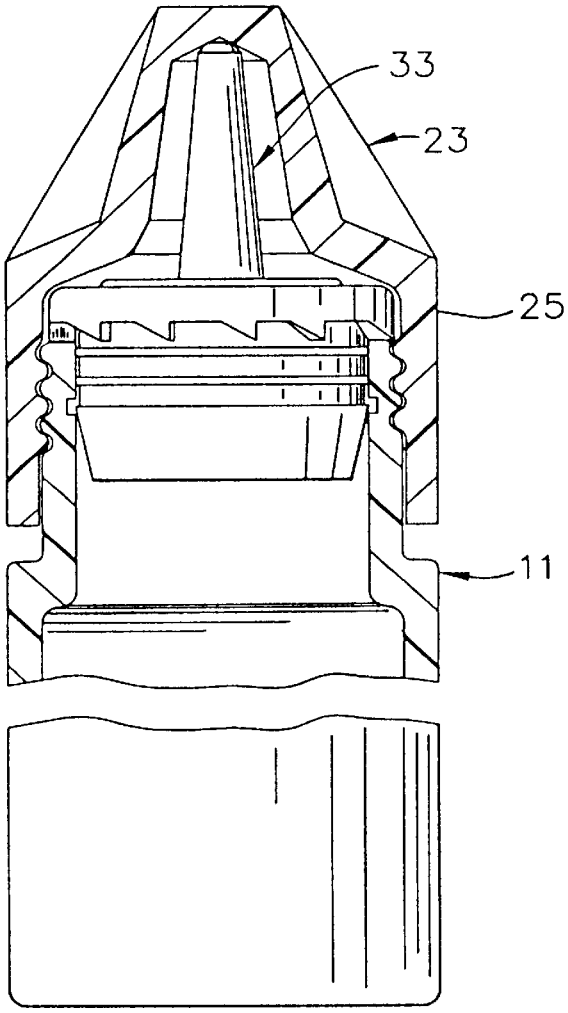
FIG. 5
FIG. 6
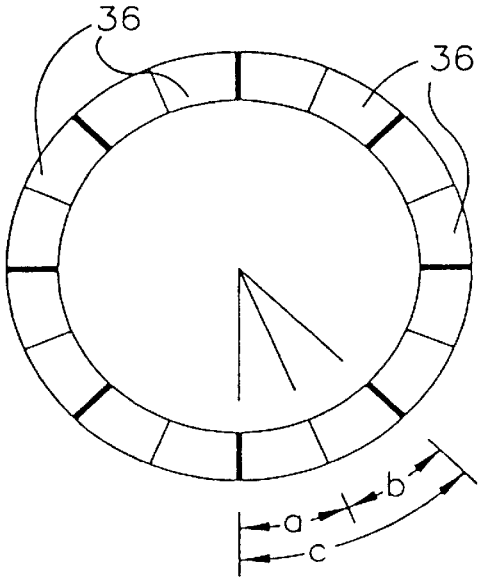

GLUE-DISPENSING BOTTLE WITH IMPROVED NOZZLE ASSEMBLY

BACKGROUND OF THE INVENTION

1. Field of the Invention

This invention relates to containers for holding and dispensing liquid. More particularly, the invention relates to a dispensing container of the type used to dispense adhesives.

2. Description of the Prior Art

Adhesives intended for a variety of uses are packaged in many different types of containers. Some adhesives, especially the polyacrylates (methacrylate and acrylate polymers, cyanoacrylates, acrylamide) are thermoplastic anaerobic glues that are typically packaged in small plastic bottles having an elongate narrow tip through which the glue is dispensed in small quantities. In conventional glue-dispensing bottles of this type, the tip is formed on a nozzle sub-assembly that is inserted into the open neck of the bottle and retained therein by frictional engagement between a cylindrical skirt on the nozzle and the interior surface of the bottle neck. An overcap is then threaded over the neck of the bottle, in enclosing relationship to the nozzle and protruding tip. When fully closed, the overcap engages against the nozzle, and the bottom end of the skirt of the overcap may engage against an upwardly facing shoulder formed on the bottle at the juncture of the threaded neck with the body of the bottle. While this arrangement works satisfactorily during initial use of the glue dispenser, small quantities of glue may get on the exterior surfaces of the nozzle and/or bottle, with the result that when the overcap is tightened on the bottle, the overcap is adhesively secured to the nozzle. Consequently, when the overcap is subsequently removed, the nozzle may also become dislodged from the neck of the bottle, resulting in spillage of the adhesive. Moreover, adhesive may get between the threaded skirt of the overcap and adjacent portions of the bottle, so that the overcap becomes adhesively secured to the bottle. When this happens, consumers sometimes resort the use of tools to free the overcap from the bottle, and this increases the potential risk of dislodging the nozzle from the bottle. Spillage of these adhesives is not only inconvenient, it can result in damage to furniture, floors, carpet and other items contacted by the spilled adhesive. More significant, however, is the danger of personal injury posed by spillage of these adhesives. For example, contact of cyanoacrylate with the chemicals in certain fabrics, or the material of the fabric itself, including stonewashed jeans, can cause a reaction that generates substantial heat, producing burns in an individual wearing the clothing.

Accordingly, there is need for a glue dispensing bottle which has inexpensive and reliable means for securing the nozzle to the bottle so that it will not become dislodged from the bottle during use, and which therefore minimizes the danger of spilling the glue.

SUMMARY OF THE INVENTION

Therefore, an object of the present invention is to provide a glue-dispensing bottle having inexpensive and reliable means for securing the nozzle sub-assembly to the bottle to prevent accidental removal of the nozzle from the bottle, and thereby prevent spillage of adhesive contained in the bottle.

Glue-dispensing bottles of the type with which the present invention is concerned typically have a cylindrical body with a reduced diameter cylindrical neck projecting upwardly therefrom, and external threads on the neck for engagement with an overcap. An axially upwardly facing shoulder is typically formed on the outside surface of the bottle at the juncture between the threaded neck and the cylindrical body. In a preferred embodiment of the present invention, the inner surface of the threaded neck is provided with an annular recess, and the nozzle for engagement on the bottle has a depending cylindrical skirt formed with an annular shoulder that engages in the annular recess in the neck of the bottle, to serve as a snap detent securing the nozzle to the bottle.

Additionally, to ensure against leakage of glue past the skirt of the nozzle and the inner surface of the cooperating neck of the bottle, at least one, and preferably two, annular seal rings are provided on the outer surface of the skirt of the nozzle for sealing engagement with the inner surface of the neck of the bottle.

To prevent relative rotation between the nozzle and the bottle when the overcap is removed from the bottle, a plurality of cooperating detents are provided between an end surface of the neck of the bottle and an enlarged annular flange on the nozzle. These detents are shaped so that it is possible to rotate the nozzle in the same direction as the cap during tightening movement of the cap on the bottle, but prevent rotation of the nozzle relative to the bottle in the same direction as rotation of the cap when the cap is rotated to unthread it from the bottle. This ensures that the nozzle remains securely attached to the bottle once it is positioned thereon, and prevents spillage of adhesive which might otherwise result if the tip where to be accidentally dislodged from the bottle.

The improved nozzle of the invention can be manufactured and assembled to the bottle by use of conventional equipment, requiring only minimal modifications to existing molds in order to provide the detents and sealing means of the invention.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein:

FIG. 5 is an enlarged view in side elevation of the improved glue-dispensing bottle of the invention, shown partially in section;

FIG. 6 is a plan view of the detents provided on the open end of the threaded neck-of the bottle and on the underside of the enlarged flange on the nozzle;

DETAILED DESCRIPTION OF THE PREFERRED EMBODIMENTS

Figure 1:
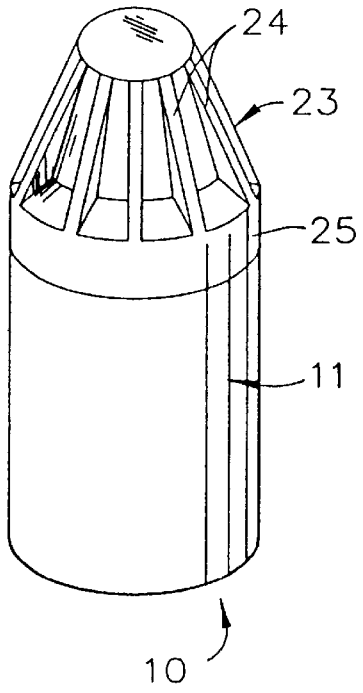
FIG. 1 (PRIOR ART)
FIG. 1 is a top perspective view of a typical conventional glue-dispensing bottle of the type with which the present invention is concerned.
Figure 2:
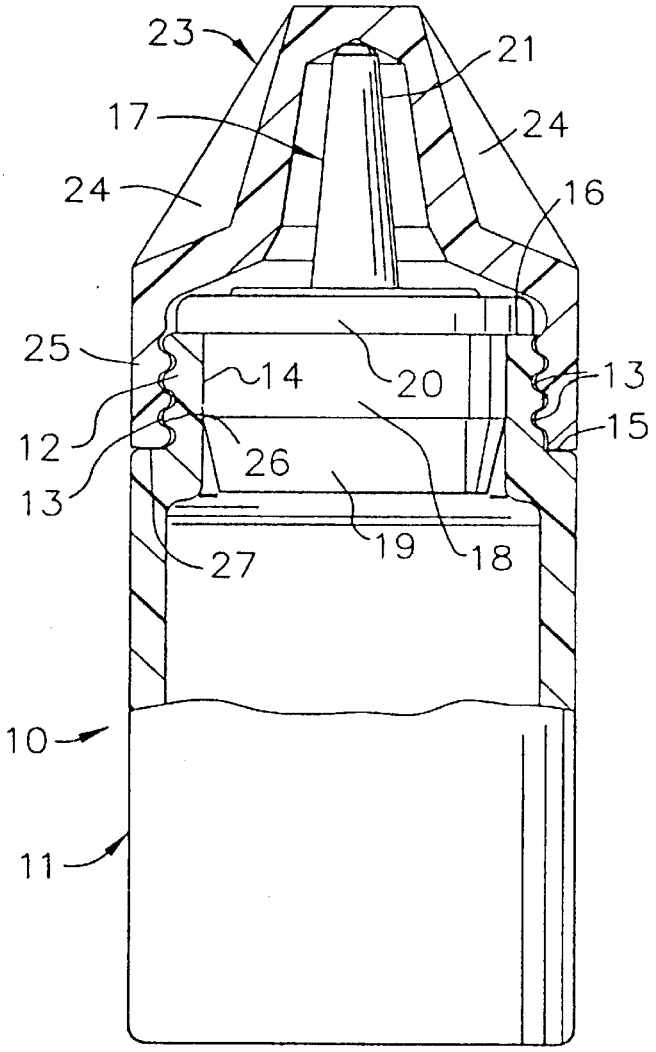
FIG. 2 (PRIOR ART)
FIG. 2 is an enlarged view in side elevation of the bottle of FIG. 1, with portions thereof shown in section.
Figure 3:
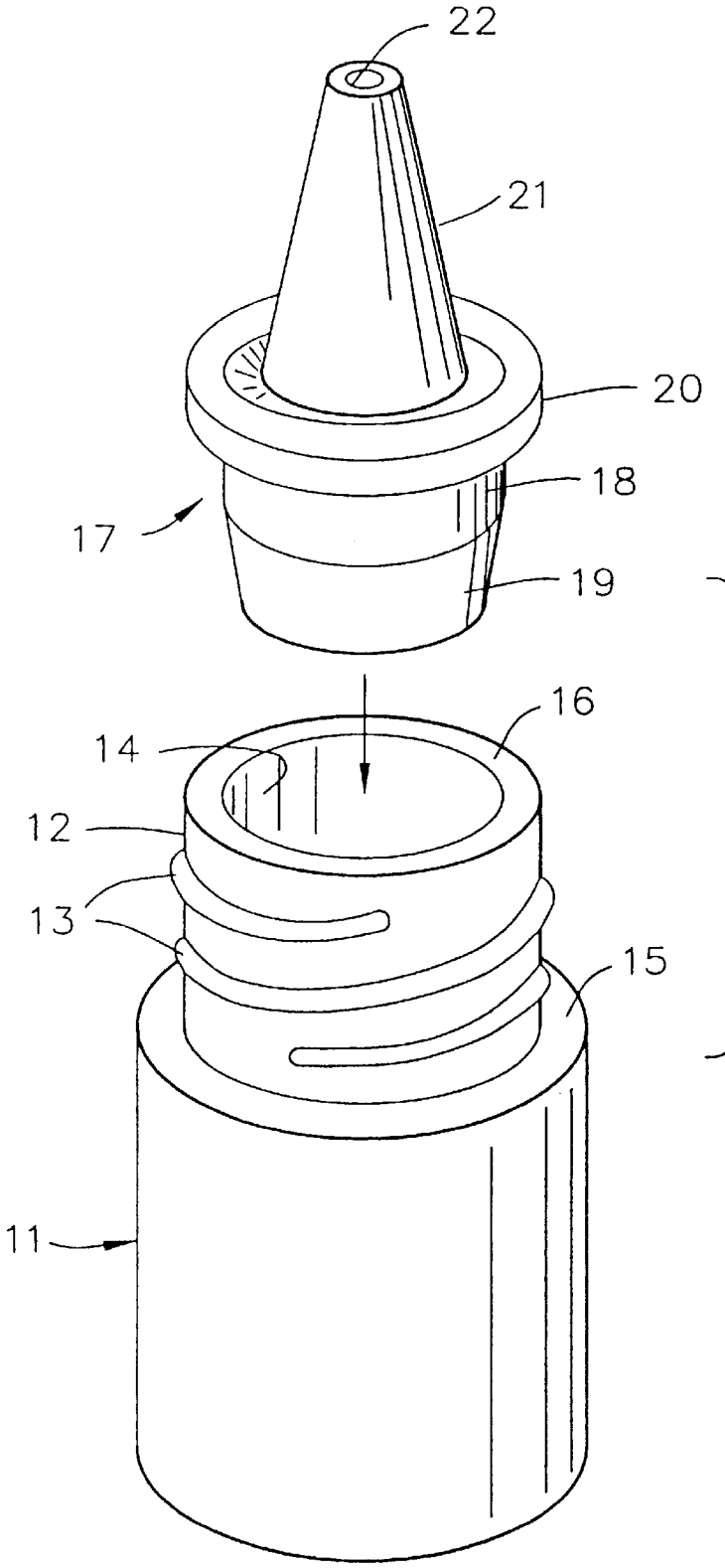
FIG. 3 (PRIOR ART)
FIG. 3 is an enlarged perspective exploded view of the bottle and nozzle as used in a prior art glue dispenser of type with which the present invention is concerned.

A conventional glue dispensing container is indicated generally at 10 in FIGS. 1–3. The conventional container includes a cylindrical bottle 11 having a reduced diameter neck portion 12 that is externally threaded at 13 and has a smooth, cylindrical interior surface 14. An annular upwardly facing shoulder 15 is formed at the juncture between the cylindrical bottle 11 and the reduced diameter neck portion 12, and an annular upwardly facing surface 16 is formed on the upper end of the threaded neck 12.

A tip or nozzle sub-assembly 17 is secured in the open end of the bottle 11 by means of a cylindrical skirt 18 frictionally engaged against the inner surface 14 of the threaded neck 12 of the bottle. The skirt has a tapered end portion 19 to facilitate entry of the skirt into the open neck. A radially enlarged flange 20 is formed on the nozzle at the upper end of skirt 18, and when the nozzle is fully engaged in the neck of the bottle, this flange lies flush against the annular surface 16 on the end of the neck of the bottle.

A reduced diameter inwardly tapering nozzle tip 21 projects upwardly from the nozzle, and has a longitudinal opening 22 through which the glue may be dispensed.

An overcap 23 is provided for engagement on the threaded neck of the bottle to enclose the nozzle tip 21. The overcap 23 has an inwardly tapered upper end with a plurality of longitudinally extending external ribs 24 to define a gripping surface to facilitate rotation of the cap. A depending skirt 25 extends downwardly in surrounding relationship to the threaded neck of the bottle, and has internal threads or grooves 26 therein for cooperation with the threads 13 on the exterior surface of the neck of the bottle. In a conventional bottle, the bottom end of the skirt has a flat annular surface 27 which may engage the shoulder 15 on the bottle when the cap is fully engaged.

During use of the bottle 10 shown in FIGS. 1–3, it is possible for glue to get on the exterior surfaces of the nozzle and bottle, including the surfaces 15 and 27, whereby the cap may become adhesively secured to the nozzle and/or bottle, making it difficult to remove. Moreover, if the overcap becomes adhesively secured to the nozzle 17, when the cap is removed the nozzle may become dislodged from the neck of the bottle, resulting in spillage of the glue.

An adhesive-dispensing container according to the invention is indicated generally at 30 in FIGS. 4–8. The dispenser of the invention includes a bottle 11 that is substantially identical to that previously described, except that the neck 12' has a plurality of upwardly projecting saw-tooth shaped teeth 31 formed on the end surface 16 of the neck 12'. In addition, an annular recess or groove 32 is formed on the inner surface 14 of the neck 12'. The neck 12' is externally threaded at 13, just as in the previously described form of the invention.

The nozzle 33 is also similar to the nozzle 17 previously described, except that the tapered lower end 19' of the skirt depending from the sub-assembly is slightly larger in diameter at its upper end, defining an annular shoulder 34 that engages in the recess 32 when the nozzle is fully engaged in the neck 12' of the bottle 11, to secure the nozzle against axial movement upwardly out of the neck of the bottle.

In addition, the outer surface of the cylindrical portion 18' of the skirt has at least one, and preferably two, annular sealing rings 35 formed on its outer surface for sealing engagement against the inner surface 14 of the neck 12' to ensure against seepage of adhesive from the bottle between the skirt 18' and surface 14 of the neck 12'.

Further, a plurality of depending saw-tooth shaped teeth 36 are formed on the underside of flange 20' for engagement with the teeth 31 on the neck of the bottle, to prevent rotation of the nozzle 33 in the same direction that the cap is rotated to be removed from the bottle. This further ensures that the nozzle will not be dislodged from the neck of the bottle upon removal of the cap.

Figure 4:
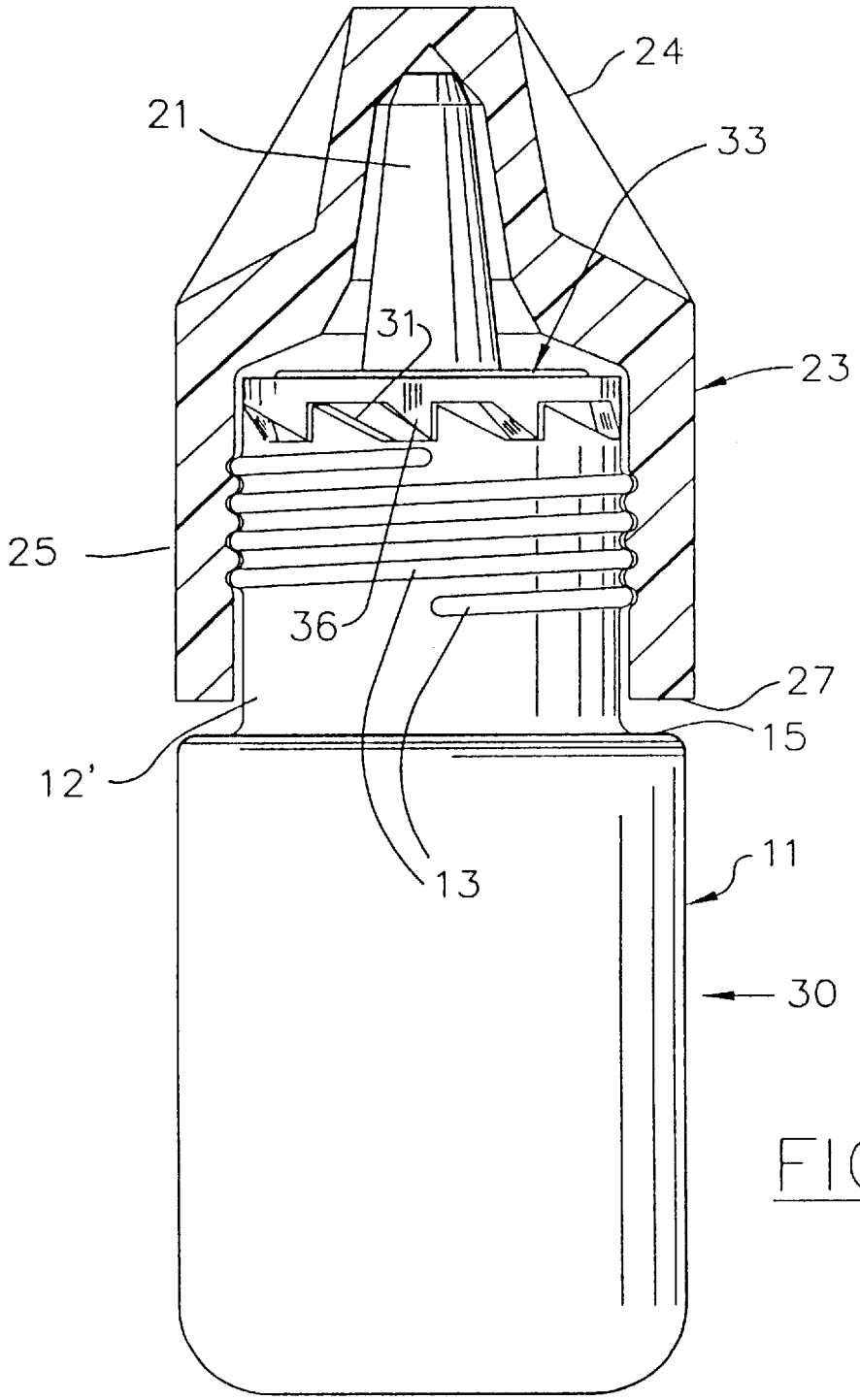
FIG. 4 is an enlarged view in side elevation of an improved glue-dispensing bottle according to the invention, showing the nozzle fully engaged on the bottle and showing in section the relationship of an overcap fully engaged on the bottle according to the invention.
Figure 8:
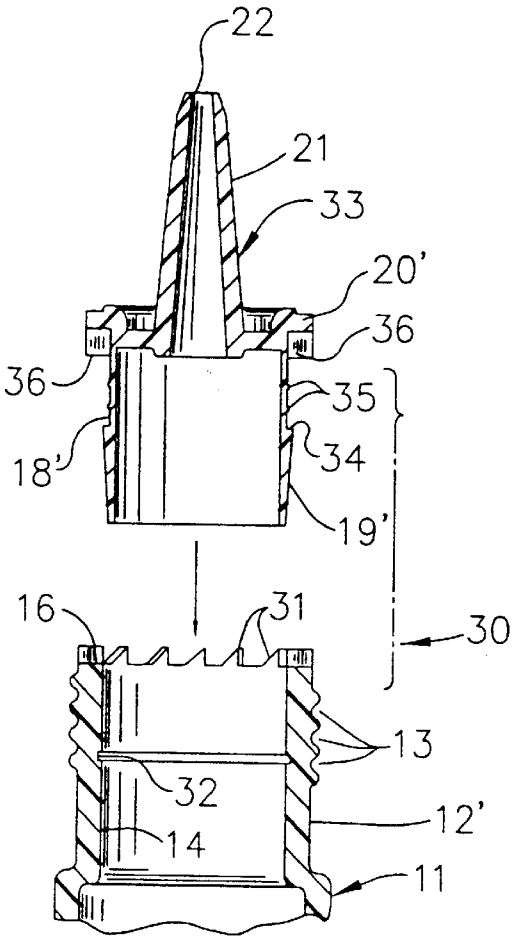
FIG. 8 is an enlarged fragmentary exploded longitudinal sectional view of the nozzle and threaded neck portion of the bottle to which the nozzle is to be attached.
Figure 7:
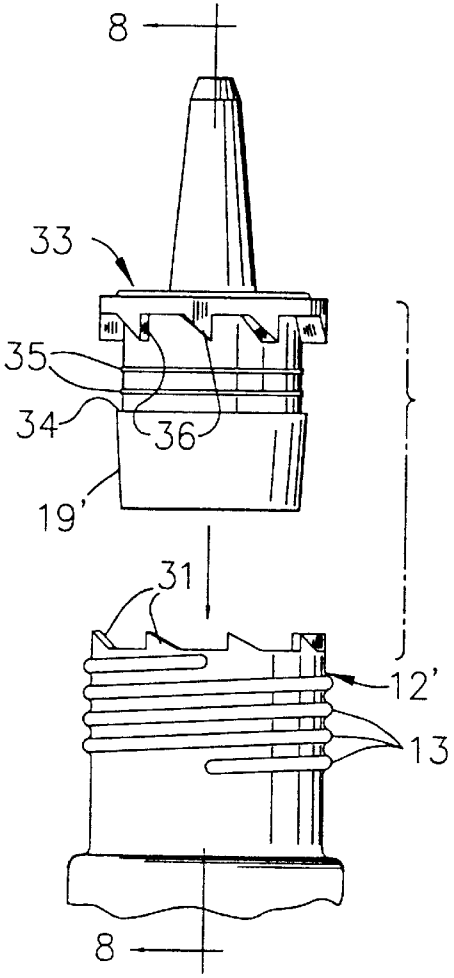
FIG. 7 is a further enlarged fragmentary exploded view in side elevation of the nozzle of the invention and the threaded neck portion of the bottle to which the nozzle is to assembled.

As seen in FIG. 4, when the nozzle 33 is fully engaged on the neck of the bottle, the teeth 31 and 36 engage to prevent clockwise rotation of the nozzle relative to the bottle. However, if the nozzle is not fully seated in the neck of the bottle, application of the cap is capable of rotating the nozzle in the same direction as closing rotation of the cap, enabling the teeth or detents 31 and 36 to become aligned with each other, and pressing the nozzle downwardly, fully seating it. In this regard, it should be noted that it is possible for the nozzle to rotate in a counter-clockwise direction, the same direction of rotation of the cap when the cap is being threaded onto the bottle, but not capable of rotation in a clockwise direction the direction of rotation of the cap when it is being removed from the bottle. It should further be noted with reference to FIG. 4 that when the cap is fully engaged on the bottle, the lower end surface 21 of the cap skirt 25 is spaced from the shoulder 15 on the bottle, thus ensuring that these parts cannot become adhesively secured together.

In a specific example of the invention, the teeth 36 are spaced apart approximately 45 degrees (angle C in FIG. 6), and adjacent teeth are spaced apart a distance equal to approximately 22.5 degrees (angle B in FIG. 6), with each tooth extending over approximately 22.5 degrees (angle A in FIG. 6).

Further, and as seen best in FIGS. 4 and 5, the lower end of skirt 25 of the cap 23 is spaced radially outwardly from the outer surface of the neck 12', thus ensuring that the cap cannot become adhesively secured to the neck of the bottle in this area. In this regard, it should be noted that the type of adhesive most commonly packaged in this type of dispenser is pressure activated, such as cyanoacrylate adhesive.

Absence of adhesion between the cap 23 and bottle 11 or nozzle 33 is further ensured by the presence in the material from which the bottle is made of mold parting agents used during manufacture of the bottle. In other words, the bottle and cap are typically manufactured from polypropelene pellets that are melted and injection blow molded to form the bottle and cap. Prior to melting of the pellets, they are washed in a silicone bath, and N, N, dimethyl capryalmide is mixed with the plastic to serve as a mold parting agent during the molding process.

While particular embodiments of the invention have been illustrated and described in detail herein, it should be understood that various changes and modifications may be made to the invention without departing from the spirit and intent of the invention as defined by the scope of the appended claims.

What is claimed is:

1. A container for holding and dispensing glue, comprising:

a hollow bottle for holding a quantity of glue to be dispensed, said bottle having a neck with an open end having a free end surface;

a nozzle secured to said open end for closing said open end but operable to enable glue to be dispensed there-through from said bottle, said nozzle including an elongate tip projecting axially therefrom;

an overcap threadably engaged with said bottle neck to cover and close said nozzle; and said nozzle and said bottle open end having interengageable detent means thereon for preventing dislodgement of said nozzle from said open end, said detent means enabling said nozzle to rotate relative to said neck in the same direction of rotation as said overcap when said overcap is rotated to thread it onto said neck, but preventing rotation of said nozzle in the direction of rotation of said overcap when the overcap is rotated to unthread it from said neck, whereby said nozzle remains stationary when the overcap is removed, to thereby break any adhesion between the nozzle and overcap to insure that the nozzle remains in place when the overcap is removed.

2. A container as claimed in claim 1, wherein:

said neck is elongate and of reduced diameter; and said nozzle has a skirt which extends in close-fitting relationship inside said neck, and a radially enlarged flange which engages over said free end of the neck, said elongate tip projecting axially beyond said flange to a free open end through which glue is dispensed.

3. A container as claimed in claim 2, wherein:

an annular shoulder is formed on said bottle at the juncture with said reduced diameter neck; and said overcap has a depending skirt which extends axially around said neck and a closed end which extends transversely over and engages and closes said tip open end when the overcap is fully engaged on the neck of the bottle, said overcap skirt being threadably engaged on said neck.

4. A container as claimed in claim 3, wherein:

said detent means is on axially confronting surfaces of said neck free end and said nozzle flange.

5. A container as claimed in claim 3, wherein:

said detent means comprises a plurality of sawtooth-shaped teeth on the free end surface of said neck, and a plurality of complementally shaped but oppositely oriented sawtooth-shaped teeth on an underside of the flange on said nozzle.

6. A container as claimed in claim 1, wherein:

said detent means includes a first detent engaged between an outer surface of said nozzle skirt and an inner surface of said neck to prevent axial movement of said skirt out of said neck, but operable to enable relative rotation therebetween, and a second detent engaged between said neck free end and said nozzle flange to prevent relative rotational movement in at least one direction between said nozzle and said bottle when said nozzle is fully engaged on said bottle.

7. A container as claimed in claim 6, wherein:

the neck is elongate and of reduced diameter, with an annular shoulder formed on said bottle at the juncture with said reduced diameter neck; and said overcap has a depending skirt which extends axially around said neck and a closed end which extends transversely over and engages and closes said nozzle tip open end when the overcap is fully engaged on the neck of the bottle.

8. A container as claimed in claim 7, wherein:

said overcap skirt is threadably engaged on said neck; and said second detent enables said nozzle to rotate relative to said neck in the same direction of rotation as said overcap when said overcap is rotated to thread it onto said neck, but prevents rotation of said nozzle in the direction of rotation of said overcap when the overcap is rotated to unthread it from said neck.

9. A container as claimed in claim 8, wherein:

said second detent comprises a plurality of sawtooth-shaped teeth on the free end surface of said neck, and a plurality of complementally shaped but oppositely oriented sawtooth-shaped teeth on an underside of the flange on said nozzle.

10. A container as claimed in claim 3, wherein:

said overcap depending skirt has an open end that remains spaced from said annular shoulder on the bottle when the cap is fully engaged on the bottle.

11. A container as claimed in claim 10, wherein:

said overcap skirt is threadably engaged on said neck; and said detent means enables said nozzle to rotate relative to said neck in the same direction of rotation as said overcap when said overcap is rotated to thread it onto said neck, but prevents rotation of said nozzle in the direction of rotation of said overcap when the overcap is rotated to unthread it from said neck.

12. A container as claimed in claim 11, wherein:

said detent means comprises a plurality of sawtooth-shaped teeth on the free end surface of said neck, and a plurality of complementally shaped but oppositely oriented sawtooth-shaped teeth on an underside of the flange on said nozzle.

13. A container as claimed in claim 11, wherein:

said detent means includes a first detent engaged between an outer surface of said nozzle skirt and an inner surface of said neck to prevent axial movement of said skirt out of said neck, but operable to enable relative rotation therebetween, and a second detent engaged between said neck free end and said nozzle flange to prevent relative rotational movement in at least one direction between said nozzle and said bottle when said nozzle is fully engaged on said bottle.

14. A container as claimed in claim 13, wherein:

said second detent comprises a plurality of sawtooth-shaped teeth on the free end surface of said neck, and a plurality of complementally shaped but oppositely oriented sawtooth-shaped teeth on an underside of the flange on said nozzle.

15. A container as claimed in claim 14, wherein:

said overcap has an axially oriented annular shoulder which engages the flange on said nozzle and presses said flange toward the bottle when the overcap is fully engaged on the bottle.

16. A container as claimed in claim 2, wherein:

said nozzle skirt has at least one annular sealing ring on an outer surface thereof which sealingly engages an inner surface of said neck to prevent leakage of glue between said neck and said nozzle skirt.

17. A container as claimed in claim 16, wherein:

said detent means includes a first detent engaged between an outer surface of said nozzle skirt and an inner surface of said neck to prevent axial movement of said skirt out of said neck, but operable to enable relative rotation therebetween, and a second detent engaged between said neck free end and said nozzle flange to prevent relative rotational movement in at least one direction between said nozzle and said bottle when said nozzle is fully engaged on said bottle.

18. A container as claimed in claim 17, wherein:

said nozzle skirt has a tapered end portion extending from a free end thereof to approximately midway of the length of the skirt, and a cylindrically-shaped portion extending from the tapered end portion to the flange, said tapered end portion having a larger diameter than the cylindrical portion where the portions meet, forming an annular shoulder facing toward the flange and defining said first detents; and an annular recess is formed in the neck inner surface for cooperation with said shoulder to effect a snap engagement between said nozzle and said neck.

19. A container as claimed in claim 18, wherein:

the locations of the recess in the neck and the shoulder on the nozzle skirt are such that when the shoulder is engaged in the recess, the flange on the nozzle is engaged against the end of the neck.

20. A container as claimed in claim 19, wherein:

an annular shoulder is formed on said bottle at the juncture with said reduced diameter neck;

said overcap has a depending skirt which extends axially around said neck and a closed end which extends transversely over and engages and closes said tip open end when the overcap is fully engaged on the neck of the bottle; and said overcap depending skirt has an open end that remains spaced from the annular shoulder on the bottle when the overcap is fully engaged on the bottle and the nozzle is fully seated in the open end of the bottle.

* * * * *